US011867469B2

(12) United States Patent
Dahlberg et al.

(10) Patent No.: US 11,867,469 B2
(45) Date of Patent: Jan. 9, 2024

(54) HEAT EXCHANGER

(71) Applicant: SWEP International AB, Landskrona (SE)

(72) Inventors: Tomas Dahlberg, Helsingborg (SE); Sven Andersson, Hassleholm (SE)

(73) Assignee: SWEP International AB, Landskrona (SE)

( * ) Notice: Subject to any disclaimer, the term of this patent is extended or adjusted under 35 U.S.C. 154(b) by 92 days.

(21) Appl. No.: 16/770,057

(22) PCT Filed: Dec. 4, 2018

(86) PCT No.: PCT/EP2018/083553
§ 371 (c)(1),
(2) Date: Jun. 4, 2020

(87) PCT Pub. No.: WO2019/110621
PCT Pub. Date: Jun. 13, 2019

(65) Prior Publication Data

US 2020/0386485 A1 Dec. 10, 2020

(30) Foreign Application Priority Data

Dec. 5, 2017 (SE) ..... 1751497-7

(51) Int. Cl.
*F28D 9/00* (2006.01)
*F28F 3/04* (2006.01)
*F28F 3/10* (2006.01)

(52) U.S. Cl.
CPC ..... *F28D 9/005* (2013.01); *F28F 3/046* (2013.01); *F28F 3/10* (2013.01); *F28F 2230/00* (2013.01); *F28F 2275/04* (2013.01)

(58) Field of Classification Search
CPC ..... F28D 9/005; F28D 9/00; F28D 9/0031; F28F 3/10; F28F 3/08; F28F 3/083;
(Continued)

(56) References Cited

U.S. PATENT DOCUMENTS 4,653,581 A * 3/1987 Yogo ..... F28D 9/0075 165/166
4,805,693 A * 2/1989 Flessate ..... F28F 3/025 165/DIG. 464
(Continued)

FOREIGN PATENT DOCUMENTS

CN 1428587 A 7/2003
CN 1708669 A 12/2005
(Continued)

OTHER PUBLICATIONS

Chinese Office Action for CN Application No. 201880077849.5 dated Jun. 23, 2021 (8 pages), English Translation provided.
(Continued)

*Primary Examiner* — Jianying C Atkisson
*Assistant Examiner* — For K Ling
(74) *Attorney, Agent, or Firm* — Merchant & Gould P.C.

(57) ABSTRACT

A brazed plate heat exchanger (100) for exchanging heat between at least two fluids comprises several elongate heat exchanger plates (110) provided with a pressed pattern comprising depressions and elevations adapted to keep the plates on a distance from one another by contact points between the elevations and depressions of neighboring plates under formation of interplate flow channels for media to exchange heat. At least four port openings are placed in corner regions of the elongate heat exchanger plates and have selective fluid communication with the interplate flow channels such that the fluids to exchange heat will flow between port openings parallel to long sides of the elongate heat exchanger plates. A circumferential seal sealing off the interplate flow channels from communication with the surroundings is provided, and the heat exchanger plates are joined by brazing. The circumferential seal results partly from contact between skirts of neighboring plates contacting one another, said skirts extending at least partly along two
(Continued)

sides of each heat exchanger plates, and partly from contact between flat areas extending along two other sides of the heat exchanger plates.

10 Claims, 5 Drawing Sheets

(58) Field of Classification Search
CPC . F28F 3/046; F28F 3/086; F28F 3/005; B23P 15/26
See application file for complete search history.

(56) References Cited

U.S. PATENT DOCUMENTS

| | | | | |
|---|---|---|---|---|
| 5,069,276 | A | 12/1991 | Seidel | |
| 5,522,462 | A * | 6/1996 | Kumar | F28D 9/005 165/166 |
| 5,988,269 | A * | 11/1999 | Karlsson | F28D 9/005 165/DIG. 372 |
| 6,142,221 | A | 11/2000 | Johansson | |
| 11,105,559 | B2 * | 8/2021 | Okubo | F28F 3/025 |
| 2001/0030043 | A1 | 10/2001 | Gleisele | |
| 2002/0050347 | A1 * | 5/2002 | Hainley | F28F 9/026 165/174 |
| 2002/0148602 | A1 | 10/2002 | Nakamura | |
| 2002/0192531 | A1 * | 12/2002 | Zimmerman | H01M 8/2483 429/492 |
| 2004/0069837 | A1 * | 4/2004 | Fujiyama | F28F 3/046 228/183 |
| 2004/0226704 | A1 * | 11/2004 | Sella | F28F 13/185 165/905 |
| 2005/0269058 | A1 * | 12/2005 | Tagesson | F28F 3/10 165/70 |
| 2006/0032621 | A1 * | 2/2006 | Martin | F28D 9/005 165/167 |
| 2007/0227716 | A1 * | 10/2007 | Dahlberg | F28F 17/005 165/167 |
| 2007/0289724 | A1 * | 12/2007 | Hoof | F28D 9/005 165/149 |
| 2008/0196873 | A1 * | 8/2008 | Svensson | F28F 3/10 165/167 |
| 2008/0202735 | A1 * | 8/2008 | Geskes | F28F 9/0265 165/157 |
| 2009/0120609 | A1 * | 5/2009 | Felgenhauer | B23K 1/0012 29/890.03 |
| 2016/0250703 | A1 * | 9/2016 | Bornegard | B23K 1/0012 165/167 |
| 2017/0184347 | A1 * | 6/2017 | Ariyama | F28D 9/005 |
| 2019/0033005 | A1 * | 1/2019 | Romlund | B21D 53/04 |

FOREIGN PATENT DOCUMENTS

| | | | | |
|---|---|---|---|---|
| CN | 1997865 | A | 7/2007 | |
| CN | 101160503 | A | 4/2008 | |
| CN | 105556231 | A | 5/2016 | |
| DE | 2109346 | | 2/1971 | |
| DE | 102009041526 | A1 * | 3/2011 | F28D 9/005 |
| EP | 0566208 | A1 | 10/1993 | |
| FR | 2806469 | A | 9/2001 | |
| GB | 1339542 | | 4/1971 | |
| JP | H02169127 | A | 6/1990 | |
| JP | 2008303846 | A | 12/2008 | |
| JP | 2009501892 | A | 1/2009 | |
| JP | 2015152285 | A | 8/2015 | |
| JP | 2016176618 | A | 10/2016 | |
| WO | 91/13309 | | 9/1991 | |
| WO | 2010/069872 | A1 | 6/2010 | |
| WO | 2010069871 | A1 | 6/2010 | |
| WO | 2010069872 | A1 | 6/2010 | |
| WO | 2010069874 | A1 | 6/2010 | |
| WO | 2011008860 | A1 | 1/2011 | |
| WO | 2011087474 | A1 | 7/2011 | |
| WO | 2015040065 | A1 | 3/2015 | |
| WO | 2015062992 | A1 | 5/2015 | |

OTHER PUBLICATIONS

International Search Report for International Application No. PCT/EP2018/083553 dated Feb. 18, 2019 (3 pages).
Japanse Office Action for corresponding Japanese Application 2020-530348 dated Nov. 24, 2022.

* cited by examiner

HEAT EXCHANGER

This application is a National Stage Application of PCT/EP2018/083553, filed 4 Dec. 2018, which claims benefit of Ser. No. 1751497-7, filed 5 Dec. 2017 in Sweden and which applications are incorporated herein by reference. To the extent appropriate, a claim of priority is made to each of the above disclosed applications.

FIELD OF THE INVENTION

The present invention relates to a brazed plate heat exchanger for exchanging heat between at least two fluids, the heat exchanger comprising several elongate heat exchanger plates provided with a pressed pattern comprising depressions and elevations adapted to keep the plates on a distance from one another by contact points between the elevations and depressions of neighboring plates under formation of interplate flow channels for media to exchange heat, at least four port openings being placed in corner regions of the elongate heat exchanger plates and having selective fluid communication with the interplate flow channels such that the fluids to exchange heat will flow between port openings parallel to long sides of the elongate heat exchanger plates and a circumferential seal sealing off the interplate flow channels from communication with the surroundings, wherein the heat exchanger plates are joined by brazing.

The invention also relates to a method for producing the heat exchanger comprised in the heat exchanger according to the invention.

PRIOR ART

Brazed plate heat exchangers have for a long time been used as an efficient way of exchanging heat between two or more media to exchange heat. Generally, brazed plate heat exchangers comprise several heat exchanger plates provided with a pressed pattern of ridges and grooves, wherein the ridges and grooves of neighboring plates form contact points keeping the plates on a distance from one another such that interplate flow channels are formed between the neighboring plates. Port openings are arranged to selectively communicate with the interplate flow channels and a seal extends along the periphery of the heat exchanger plates in order to seal the interplate flow channels such that no fluid will leak from the interplate flow channels. After the heat exchanger plates have been stacked in a stack, the heat exchanger plates are brazed together to form a heat exchanger.

The circumferential seals may be made in (at least) two different ways, the most common way being to provide the plates with a circumferential skirt extending around the periphery of the heat exchanger pates, wherein skirts of neighboring plates will form an overlapping contact sealing off the interplate flow channels. A more uncommon solution is to provide the heat exchanger plates with flat areas that are arranged to contact flat areas of a neighboring heat exchanger plate along the circumference of the heat exchanger plates. This solution is, however, uncommon, mainly due to the fact that this solution will give flow channels that have lateral channels where no heat exchange will take place.

Heat exchanger plates for brazed plate heat exchangers are generally pressed in powerful hydraulic presses, wherein the pressed pattern, the height of the port openings and the circumferential skirt are pressed into a flat plate in one single operation.

Although pressing of the heat exchanger plates in one single operation gives a satisfactory result, it is not free from problems: First, the force necessary to press the plate becomes very large if the plates are large (pressing forces of several thousands of tons are not unusual), which requires large presses which are expensive and consume much electrical power.

Another way of forming the heat exchanger plates is roll forming. By roll forming, it has, hitherto not been possible to provide the heat exchanger plates with circumferential skirts, but only circumferential sealing surfaces adapted to be flat brazed to similar surfaces of neighbouring plates. As mentioned above, heat exchangers provided with such surfaces are less efficient than heat exchangers sealed by overlappingly interacting circumferential skirts, due to the shirt-circuiting straight channel with nor heat exchange inevitably being formed for one of the channels.

It is the object of the present invention to provide a heat exchanger and a method for producing such a heat exchanger that overcomes the above and other problems.

SUMMARY OF THE INVENTION

The above and other problems are solved by a heat exchanger wherein the circumferential seal results partly from contact between skirts of neighboring plates contacting one another, said skirts extending at least partly along the long sides of each heat exchanger plates, and partly from contact between flat areas extending along short sides of the heat exchanger plates.

Preferably the heat exchanger plates are made from austenitic stainless steel having a thickness of 0.1 to 2 mm, since such a thickness will give the required strength while enabling low cost production.

In one embodiment of the invention, the selective fluid flow between the port openings and the interplate flow channels is achieved by providing some port openings on a high level and some port openings on a low level such that a seal will occur if areas surrounding the port openings contact one another and communication between port opening and interplate flow channel will occur when the areas surrounding the port openings does not contact one another. This embodiment is beneficial in that no extra sealing rings must be provided in order to achieve the selective communication between the port openings and the interplate flow channels.

In one embodiment of the invention, the heat exchanger plates are identical and every other plate is turned 180 degrees in its plane prior to being placed in a stack to form the heat exchanger. This embodiment is beneficial in that an entire heat exchanger can be manufactured from only one type of heat exchanger plate.

In one embodiment of the invention, the skirts that extend at least partly along the long sides of the heat exchanger plates are arranged close to perpendicular relative to a plane of the heat exchanger plates, such that skirts of neighboring plates will contact one another in an overlapping fashion and after brazing provide a seal for the interplate flow channels. This embodiment is beneficial in that it gives a heat exchanger with an efficient heat transfer.

In one embodiment of the invention, the flat seal along the short ends of the heat exchanger plates is provided by elongate areas adapted to contact one another in the same fashion as areas surrounding the port openings contact one another in order to provide for the selective communication between the port openings and the interplate flow channels. This embodiment is beneficial in that the lateral distribution of fluids will be efficient and in that the heat exchanger plates may be manufactured by roll forming.

In one embodiment of the invention, a sealing comprising both a skirt-to-skirt sealing and a flat sealing is provided in the interjunction between the flat sealing surfaces and skirts sealings.

In one embodiment of the invention, the port openings are droplet shaped in order to provide for an as large port opening area as possible.

In one embodiment of the invention, the skirts extend along the entire long sides of the heat exchanger plates. This embodiment is beneficial in that it provides for a strong heat exchanger having an equal width along the length of the heat exchanger.

In one embodiment of the invention, the heat exchanger plates are manufactured by roll forming. This embodiment is beneficial in that roll forming provides for a cost and energy efficient way of manufacturing heat exchanger plates. Moreover, the invention solves the above and other problems by a method for forming heat exchanger plates comprised in a heat exchanger according to any of the preceding claims, comprising the step of:

Feeding blanks or a continuous strip of sheet metal into a roll forming apparatus comprising at least two rolls having a pattern comprising ridges and grooves adapted to press a pattern comprising ridges and grooves into the blanks;

Stamping port openings in the blanks or strip of sheet metal; and

In the case of a strip being fed into the roll forming apparatus, cutting the strip into a length corresponding to a desired length of the heat exchanger plate. In one embodiment of the method, one of the rolls may be powered and the other may rotate freely. This embodiment is beneficial in that a minimal amount of stress will be induced in the pressed plate by the roll forming operation.

In other embodiments of the method, both rolls may be powered.

In still another embodiment of the invention, the rolls may have different diameters. This is beneficial in that a high "nip force" may be achieved while having at least one large diameter roll.

BRIEF DESCRIPTION OF THE DRAWINGS

In the following, the invention will be described with reference to the appended drawings, wherein.

DESCRIPTION OF EMBODIMENTS

Figure 1:
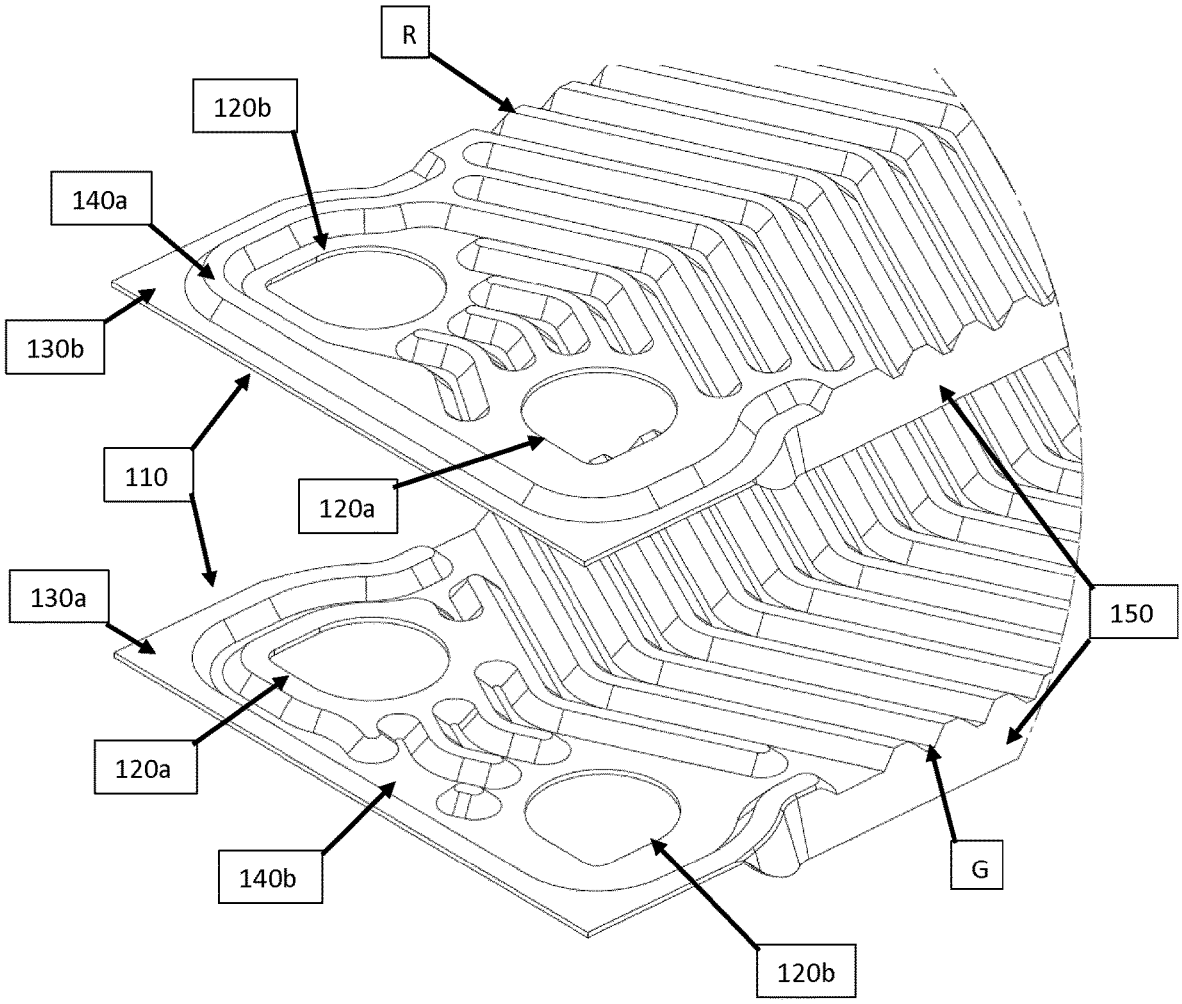
FIG. 1 is an exploded perspective view showing short ends of two neighboring heat exchanger plates according to one embodiment of the present invention.

In FIG. 1, short ends of two heat exchanger plates 110 are shown. The heat exchanger plates 110 may be made from e.g. austenitic stainless steel in a thickness of 0.1 to 2 mm, but may also be made from other materials in other thicknesses. The short ends each comprise two port openings 120*a* and 120*b*, wherein the port openings 120*a* are provided on a high level and the port openings 120*b* are provided on a low level. The short ends of each heat exchanger plate 110 are not similar. Rather, sealing surfaces 130*a*, 130*b*, and 140*a*, 140*b*, respectively, and areas surrounding the port openings 120*a*, 120*b* are mirror images of one another. The sealing surface 130*b*, the sealing surface 140*b* and the area surrounding the port openings 120*b* are located on a low level, whereas the sealing surface 130*a*, the sealing surface 140*a* and the areas surrounding port openings 120*a* are located on a high level.

When the heat exchanger plates 110 are stacked in a stack to form a heat exchanger, every other exchanger plate 110 is rotated 180 degrees in its plane compared to the neighboring heat exchanger plates, meaning that there will be an alternating contact between sealing surfaces 130*a* and 130*b* and between port openings 120*a*, 120*b* in every other neighbouring plate contact and between sealing surfaces 140*a* and 140*b* and the other port openings 120*a* and 120*b* in the other neighbouring plate contacts. When brazed, brazing material will fill the minute space between contacting surfaces of neighbouring plates, hence creating a seal between the contacting surfaces when the brazing material has cooled down and solidified.

Also, the heat exchanger plates are provided with a pressed herringbone pattern of ridges R and grooves G. Due to the herringbone pattern, the ridges and grooves of neighboring plates will form contact points once every other plate has been turned 180 degrees in its plane, such that the heat exchanger plates will be kept on a distance from one another under formation of interplate flow channels. Also the contact points between the ridges and grooves of neighbouring plates will be filled with brazing material and hence create a joint between the ridges and grooves of neighboring plates.

Along part of the long side of the heat exchanger plates, skirts 150 are provided. These skirts 150 are arranged close to perpendicular relative to a plane of the heat exchanger plates, such that skirts 150 of neighboring plates will contact one another and after brazing provide a seal for the interplate flow channels.

In the interjunction between the sealing surfaces 140*a*, 140*b* and the skirts 150, there is an overlapping sealing comprising both a skirt-to-skirt sealing by overlap of the skirts 150 and a sealing between surfaces 140*a*, 140*b* and 130*a*, 130*b*.

By the combination of "flat seal" along the short sides and around some port openings and a skirt-to-skirt seal along the long sides, a heat exchanger having beneficial properties is attained. Unlike heat exchangers having "flat seals" along the long sides of the heat exchanger, there will be no by-pass of fluid that will not exchange heat with media flowing in neighbouring plate interspaces, which is inevitable for heat exchangers wherein the long sides are flat sealed.

There will, however, be some short-circuiting of fluid along the short sides of the heat exchangers. This is, however, beneficial, since this short-circuiting will help lateral distribution of the fluid.

Figure 2:
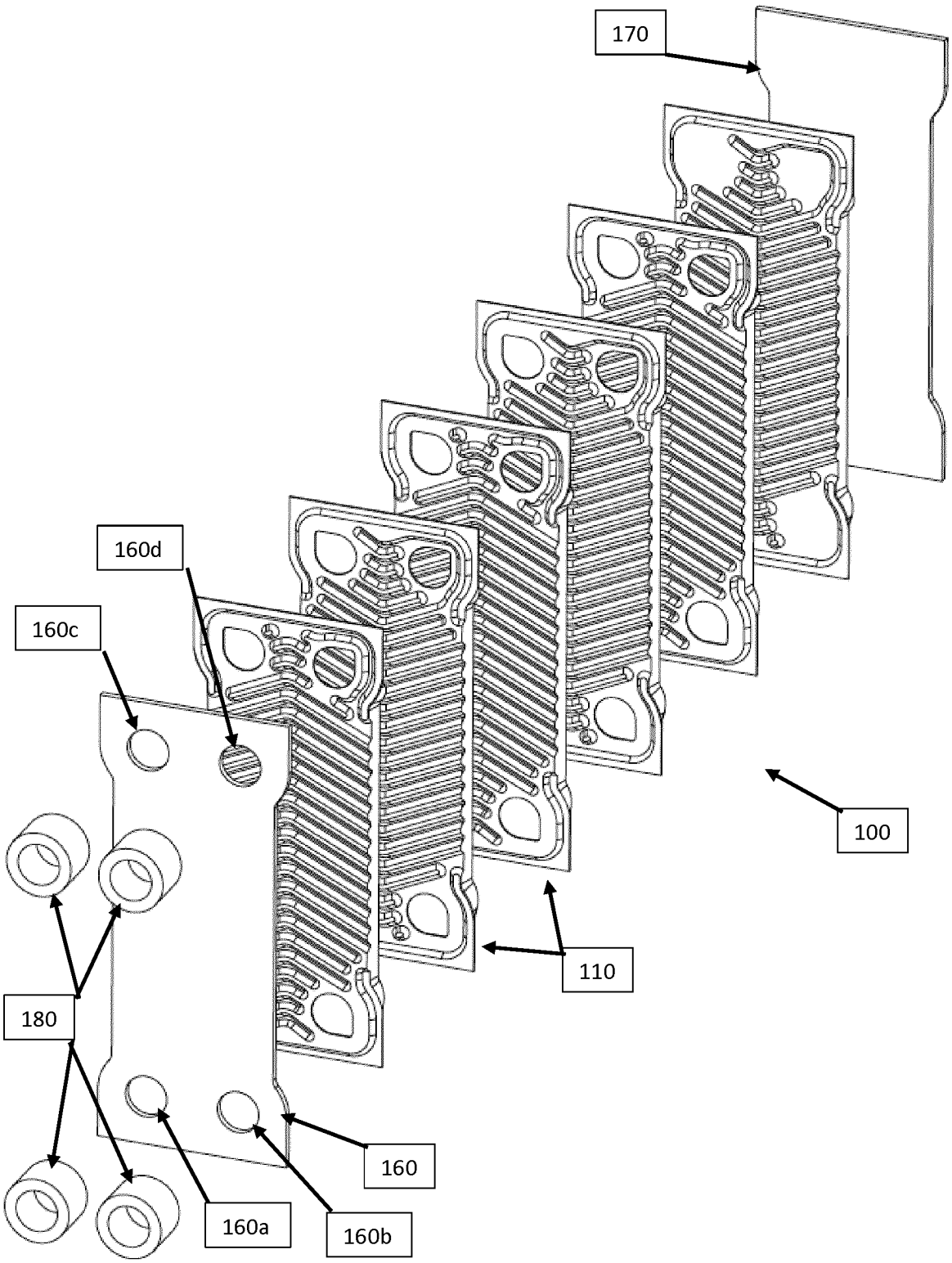
FIG. 2 is an exploded perspective view of a heat exchanger according to one embodiment of the present invention, said heat exchanger comprising heat exchanger plates according to FIG. 1.

In FIG. 2, a heat exchanger 100 comprising eight heat exchanger plates 110, a start plate 160, an end plate 170 and four port connections 180 is shown in an exploded perspective view. The start plate 160 is provided with four port openings 160*a*-160*d*, which are aligned with the port openings 120*a*, 120*b* (see FIG. 1) of the heat exchanger plates 110. As can be seen in FIG. 2, every other heat exchanger plate 110 is turned 180 degrees in its plane as compared to its neighboring plates, and due to the arrangement of the areas surrounding the port openings, there will be a selective fluid communication between the port openings and the interplate flow channels. Also, it should be noted that the port openings 120*a*, 120*b* of the heat exchanger plates 110 are not circular. Rather, they are droplet shaped in order to increase the flow area thereof. However, every possible port opening configuration—including circular—may be used without departing from the invention.

Figure 3:
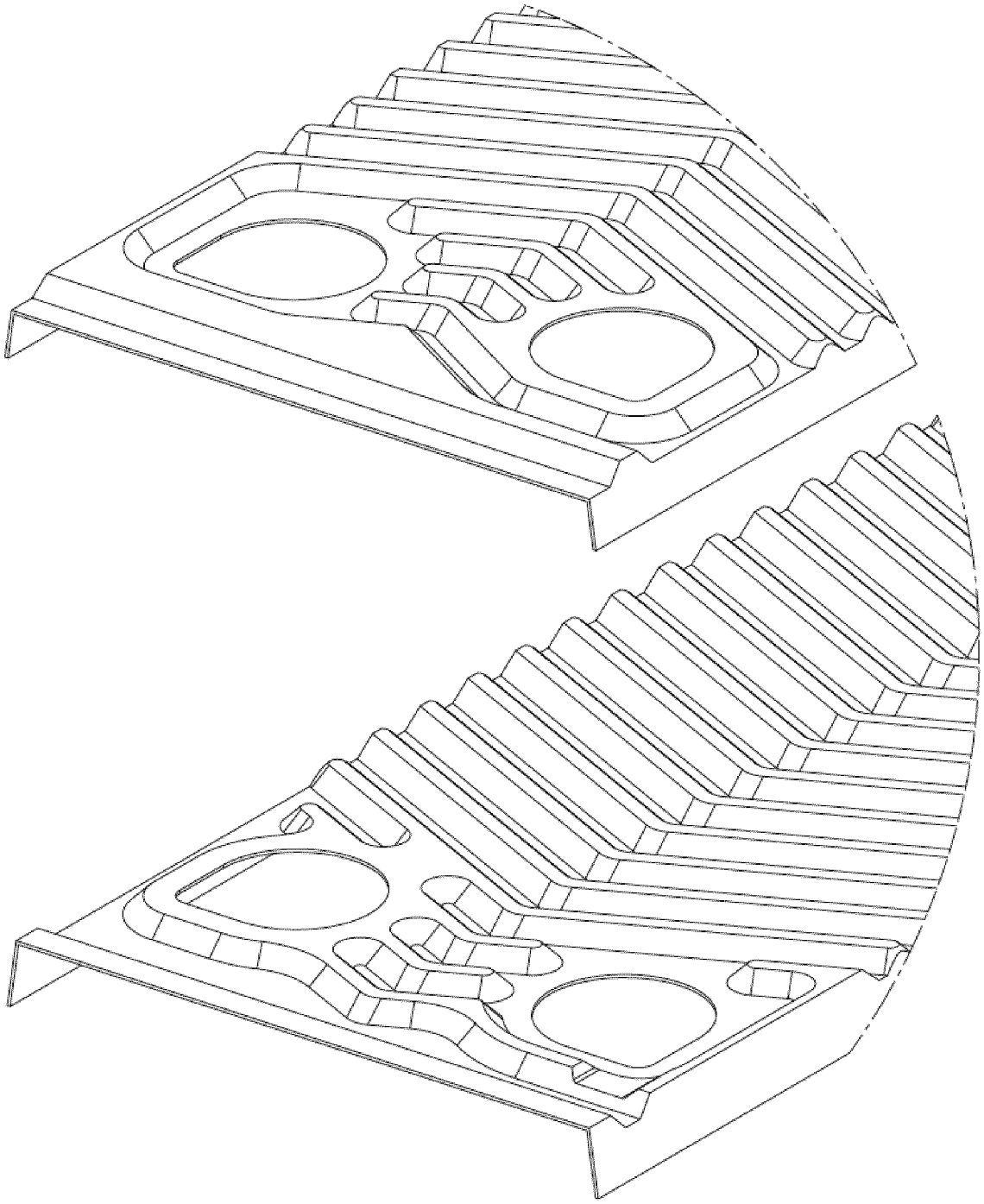
FIG. 3 is an exploded perspective view showing short ends of two neighbouring heat exchanger plates according to another embodiment of the present invention.
Figure 4:
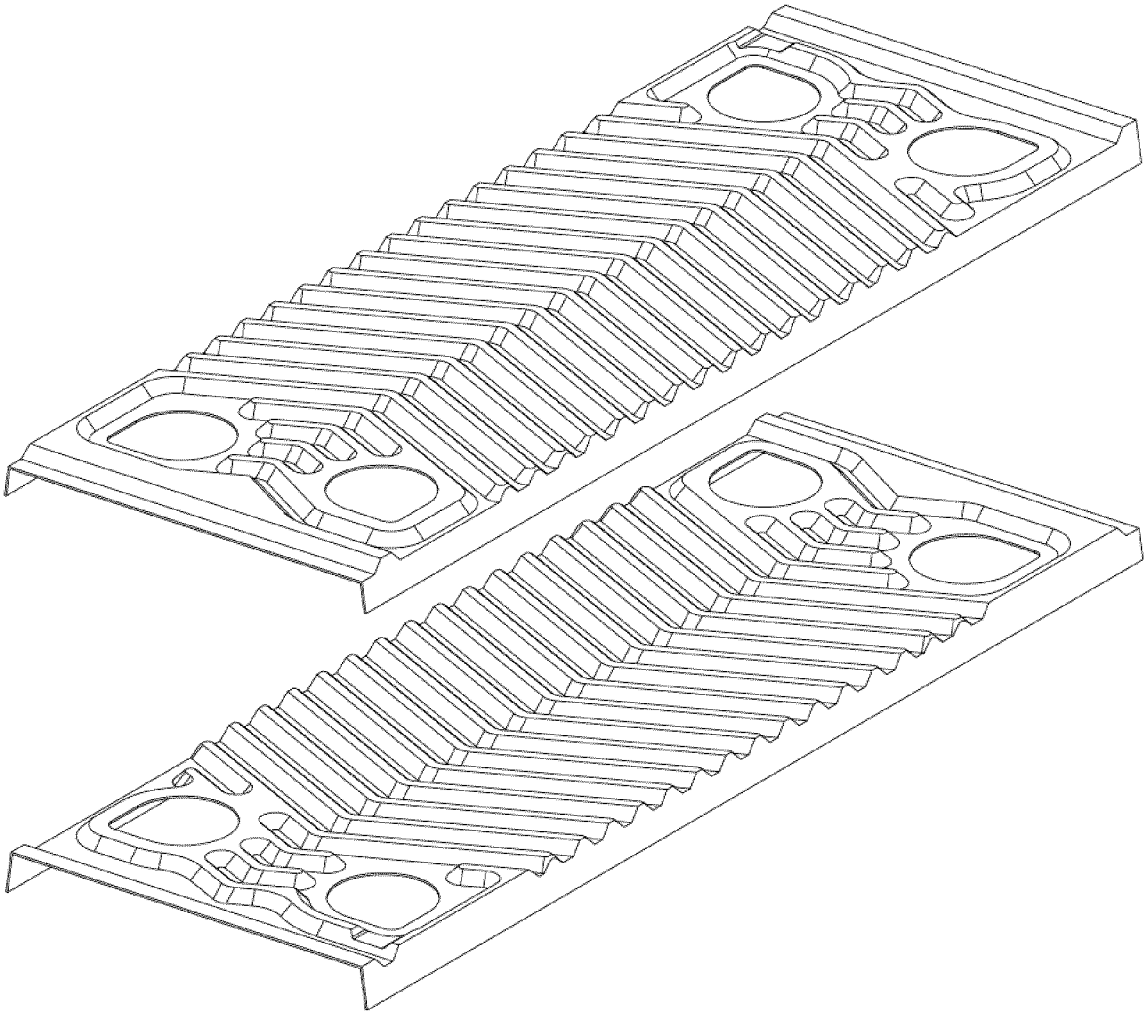
FIG. 4 is an exploded perspective view of two heat exchanger plates according to FIG. 3 comprised in a heat exchanger according to another embodiment of the present invention.

In FIGS. 3 and 4, another embodiment of the present invention is shown. In this embodiment, the skirt-to-skirt seal extends along the entire long side of the heat exchanger plates. This is beneficial in that the width of the heat exchangers will be equal over the entire length. It should be noted that the port openings and the sealing surfaces near the short sides of the heat exchanger plates are identical to the corresponding surfaces of the embodiment shown in FIGS. 1 and 2.

The most significant benefit with the heat exchanger according to the present invention is, however, that it is possible to roll-form the heat exchanger plates 110, rather than pressing the heat exchanger plates in an "ordinary" one stroke hydraulic press.

Figure 5:
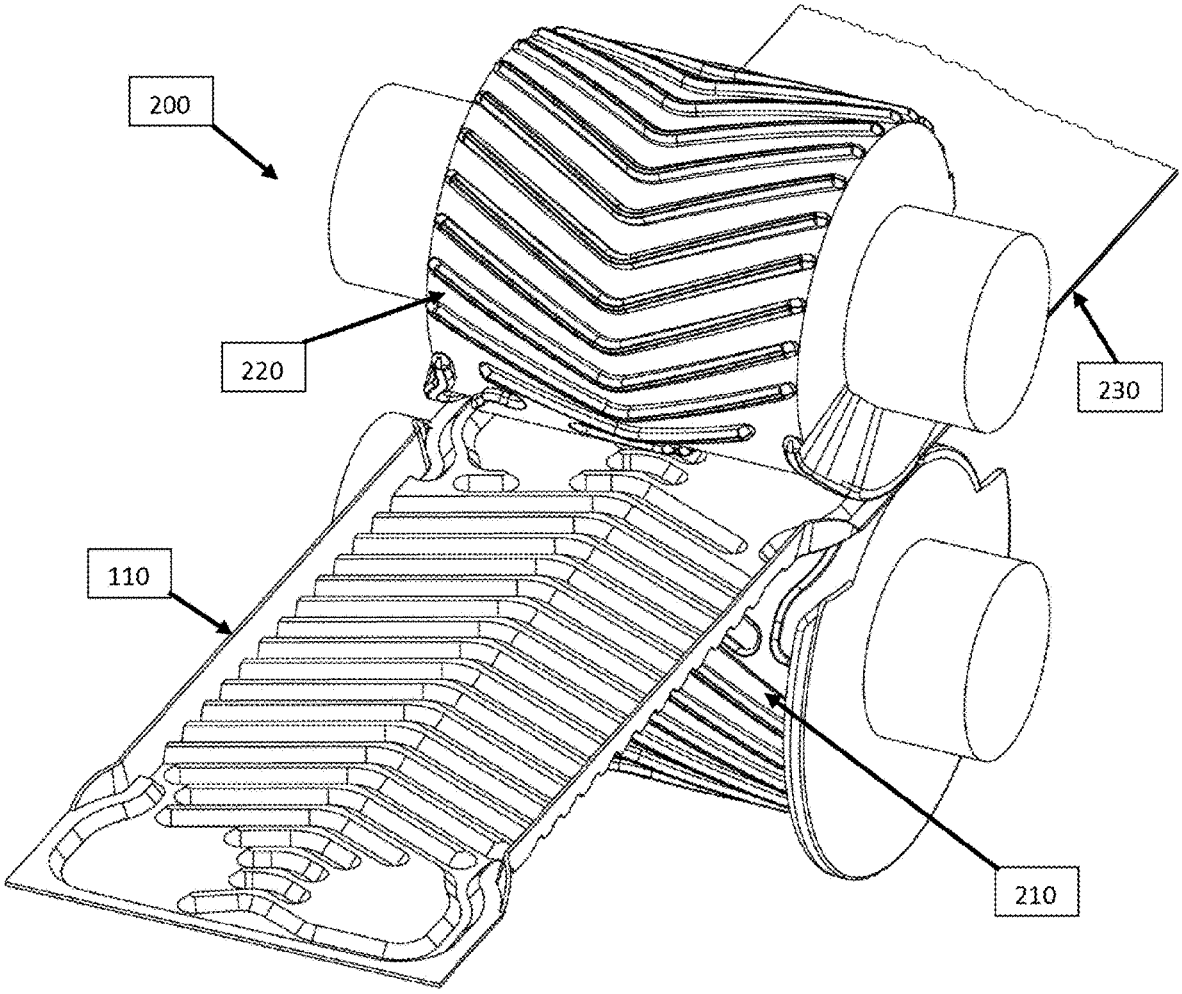
FIG. 5 is a perspective view showing roll forming of heat exchanger plates according to the present invention.

With reference to FIG. 5, roll forming of a heat exchanger plate 110 in a roll forming apparatus 200 is shown. The roll forming apparatus 200 comprises two opposing rolls 210, 220, each comprising a pattern of ridges and grooves adapted to press a corresponding pressed pattern into a sheet metal plate which is rolled between the rolls in the form of a strip 230 of sheet metal fed from a coil (not shown). A gearing system (not shown) ensures that the rolls 210, 220 will rotate coherently, such that a proper pressed pattern will result in the sheet metal plates that travels between the rolls. It should be noted that in some cases, i.e. where the patterns of the opposing rolls grab into one another, it might not be necessary with a gearbox ensuring coherence between the rolls; it might actually be advantageous if the rolls may rotate slightly back and forth relative to one another, hence allowing for stress relief of the plate being provided with the pressed pattern. In order to cut the pressed sheet metal plates, a cutting step may be included in the pattern of ridges and grooves to be pressed into the sheet metal plates. Alternatively, the cutting takes place in a consecutive process step, and may be performed by e.g. a roll cutting, a process well known by persons skilled in the art.

In one embodiment of the invention, the opposing rolls are controlled by step motors, such that the angular relationship between the rolls may be controlled. Such control may be necessary in order to reduce or control bending of the plate resulting from the pressing operation.

In one embodiment of the invention, the diameters of both rolls are identical. In other embodiment of the invention, the rolls may have different diameter; it is, however, beneficial if the roll circumferences are such that the circumferences of both rolls are equal to the length of a certain number of heat exchanger plates.

For example, a pair of rolls may comprise a first roll having a circumference equaling two heat exchanger plate lengths and a second roll having a circumference equaling one heat exchanger plate length. In such an arrangement, the smaller roll will rotate twice as fast as the larger roll. In other embodiments, the relationship between the large roll and the small roll may be e.g. 1:3 or 2:3, wherein the rotational speeds of the rollers will be controlled accordingly.

In FIG. 5, the sheet metal is fed to the opposing rolls in the form of the continuous strip 230 from a coil (not shown). The strip of sheet metal may be provided with a coating made from a brazing material, i.e. a metal or alloy that has a lower melting temperature than the sheet metal itself.

Alternatively, the brazing material may be provided as a strip of foil (not shown), which is fed into the roll forming apparatus 200 parallelly to the strip of sheet metal.

Alternatively, the brazing material may be sprayed or rolled onto the pressed sheet metal plates after pressing.

Also, the brazing material may be applied to the plates in the form of a paste comprising a brazing alloy powder, a binder and a volatile solvent. Preferably, the brazing material paste is applied close to, or at, contact points between the pressed pattern of neighboring plates by screen printing.

The sheet metal to be pressed may also be provided to the roll forming apparatus in form of so called "blanks", i.e. sheet metal strips having been cut into suitable lengths prior to the pressing operation. The blanks may also be provided with holes for the port openings 120*a*, 120*b*. Both the cutting of the plates into the proper length and the provision of the holes forming the port openings may be performed by a single roll cutting step, but may also be performed by e.g. press cutting of the sheet material. Press cutting has, however, the drawback of being a discontinuous process, which will disturb the continuous roll forming process if no equalization steps are arranged in the production line between the discontinuous press cutting process and the continuous roll forming processes.

As briefly mentioned above, the plates may bend during the roll forming operation. Such bending may be avoided by controlling the rotational velocity of the rolls (and the dislocating eccentricity of the roller's mutual rotational positioning, but if such control is not sufficient, it might be necessary to provide further bend reducing rolls placed "downstream" the roll forming apparatus. The bend reducing rolls are preferably placed in a trefoil or shamrock configuration, such that a plate entering the bend reducing roll arrangement will be bent to plasticize to the correct shape.

In another embodiment of the invention, the plates are straightened by a press tool having a shape allowing a plate to be plasticized to a correct shape.

After the roll forming, the cutting of the plates and the provision of brazing material to the plates, the heat exchanger plates are placed in a stack, wherein, if the heat exchanger plates are identical, every other plate is turned 180 degrees in its plane compared to its neighboring plates. (NB: if two, four, or any other even number of plates are pressed in one revolution of the rollers, it is not necessary to turn the plates in their plane, since the pressed pattern of the plates then can be adapted such that the neighboring plates cooperate in the desired manner). Due to the provision of the skirts 150 along the long sides of the heat exchanger plates 110, the plates will self-centering in the lateral direction. However, there will be no corresponding self-centering function in the longitudinal direction, since the short-sides of the plates are provided with "flat seals", which will give no longitudinal interlock between the plates. Therefore, it may be crucial that some kind of external frame secures the longitudinal positioning. One way of securing that the longitudinal positioning of the plates in the stack of plates is correct is to press the stack of plates between two "walls", wherein the distance between the "walls" is equal to the length of a heat exchanger plate.

If required, end plates (not shown) may be placed on either sides of the stack of heat exchanger plates. The end plates may be made from thicker gauge sheet metal than the heat exchanger plates in order to provide rigidity to the heat exchanger and to enable secure fastening of e.g. connections to the port openings 120*a*, 120*b*. Preferably, one of the end plates is not provided with port openings. The end plates may have a similar shape as the heat exchanger plates in order to provide for an interplate flow channel between the end plate end its neighboring heat exchanger plate 110, but other shapes may be used as well. It should be noted that if the end plates are formed in a similar manner as the heat exchanger plates 110, i.e. with ridges and grooves in order to provide for an interplate flow channel with a neighboring heat exchanger plate 110, the present invention is especially valuable for providing thicker gauge plates with a pressed pattern, since the press force often is critical for thicker gauge plates.

As a last step, the stack of heat exchanger plates are brazed to one another in a furnace which is heated to a temperature sufficient to melt the brazing material—partly or fully. A fixture may be used in order to secure that all plates are properly positioned relative to one another during the brazing operation.

The invention claimed is:

1. A brazed plate heat exchanger for exchanging heat between at least two fluids, the heat exchanger comprising:

(a) several heat exchanger plates, wherein each of the several heat exchanger plates has sealing surfaces and a pressed pattern comprising depressions and elevations adapted to keep the plates on a distance from one another by contact points between the elevations and the depressions of neighboring heat exchanger plates of the several heat exchanger plates under formation of interplate flow channels for media to exchange heat;

(b) at least four port openings being arranged through each of the several heat exchanger plates and being placed in corner regions of the several heat exchanger plates and having selective fluid communication with the interplate flow channels such that the fluids to exchange heat will flow between the port openings of the several heat exchanger plates; and (c) a circumferential seal sealing off the interplate flow channels from communication with surroundings, wherein the several heat exchanger plates are joined by brazing, wherein the circumferential seal results partly from contact between skirts of the neighboring heat exchanger plates of the several heat exchanger plates contacting one another and forming skirt brazed areas, said skirts extending at least partly along only two opposite sides of each of the several heat exchanger plates, and partly from contact between flat brazed areas in the sealing surfaces of the neighboring heat exchanger plates of the several heat exchanger plates contacting one another and extending along two other opposite sides of each of the several heat exchanger plate, wherein each port opening of the several heat exchanger plates is surrounded by a first flat brazing surface on a first side and a second flat brazing surface on a second side, and wherein the first flat brazing surface and the second flat brazing surface of at least two of the port openings of each of the several heat exchanger plates are provided on a level different from a level of the first flat brazing surface and the second flat brazing surface of at least two other of the port openings of each of the several heat exchanger plates, and thereby providing selective fluid flow between the port openings and the interplate flow channels.

2. The brazed plate heat exchanger according to claim 1, wherein the heat exchanger plates are made from austenitic stainless steel having a thickness of 0.1 to 2 mm.

3. The brazed plate heat exchanger according to claim 1, wherein the several heat exchanger plates are identical and wherein every other plate is turned 180 degrees in its plane prior to being placed in a stack to form the brazed heat exchanger.

4. The brazed plate heat exchanger of claim 1, wherein the skirts that extend at least partly along the only two opposite sides of each heat exchanger plate of the several heat exchanger plates are arranged such that the skirts of neighboring plates will contact one another in an overlapping fashion and after brazing provide the circumferential seal for the interplate flow channels.

5. The brazed plate heat exchanger of claim 1, wherein the flat brazed areas along the two other sides of the several heat exchanger plates is provided by elongate areas adapted to contact one another to provide for the selective fluid communication between the port openings and the interplate flow channels.

6. The brazed plate heat exchanger of claim 1, wherein an overlap between the flat brazed areas and the skirt brazed areas is provided.

7. The brazed plate heat exchanger according to claim 1, wherein the port openings are droplet shaped.

8. The brazed plate heat exchanger according to claim 1, wherein the skirts extend along an entire length of the only two opposite sides of each of the several heat exchanger plates.

9. The brazed plate heat exchanger according to claim 1, wherein the heat exchanger plates are manufactured by roll forming.

10. The brazed heat exchanger according to claim 1, wherein the flat brazed areas comprise flat seals.

* * * * *